United States Patent [19]

Inoue et al.

[11] Patent Number: 5,054,190

[45] Date of Patent: Oct. 8, 1991

[54] METHOD FOR MANUFACTURING A THERMAL HEAD

[75] Inventors: Nobuhiro Inoue; Akira Nakano, both of Tokyo; Nobuhiro Oshima, Yokohama, all of Japan

[73] Assignee: Kabushiki Kaisha Toshiba, Kawasaki, Japan

[21] Appl. No.: 623,087

[22] Filed: Dec. 6, 1990

[30] Foreign Application Priority Data

Mar. 19, 1990 [JP] Japan ..... 2-66958

[51] Int. Cl.[5] ..... H05B 3/00

[52] U.S. Cl. ..... 29/611; 29/621; 346/76 PH

[58] Field of Search ..... 29/611, 620, 621; 346/76 PH; 338/308, 309

[56] References Cited

U.S. PATENT DOCUMENTS 2,910,664 10/1959 Lanning ..... 29/620
4,259,564 3/1981 Ohkubo et al. ..... 346/76 PH
4,446,355 5/1984 Sato et al. ..... 346/76 PH
4,514,736 4/1985 Moriguchi et al. ..... 346/76 PH
4,698,643 10/1987 Nishiguchi et al. ..... 346/76 PH
4,806,106 2/1989 Mebane et al. ..... 29/611

*Primary Examiner*—P. W. Echols
*Attorney, Agent, or Firm*—Finnegan, Henderson, Farabow, Garrett, and Dunner

[57] ABSTRACT

A substantially rectangular insulating substrate is prepared. Next, pairs of lead electrodes are formed on the substrate such that they extend in parallel with regular intervals and slantwise with reference to the longitudinal direction of the substrate. The electrodes are formed by use of a lithography technology, including deposition and etching. Then, a resistor material is pasted on the substrate and the electrodes by screen printing, to thereby form a strip-shaped resistor extending in the longitudinal direction. Finally, a protective layer is formed on the resultant structure, so as to prevent the resistor and the electrodes from being oxidized or worn away, thereby completing the fabrication of a thermal head. In this thermal head, each of those portions of the strip-shaped resistor which are defined by a pair of adjacent lead electrodes serves as a parallelogrammatic heating resistor used for recording one pixel.

4 Claims, 8 Drawing Sheets

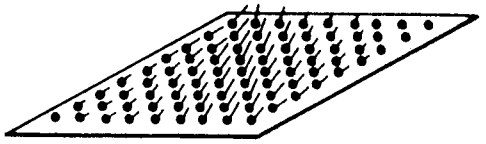
FIG. 7A
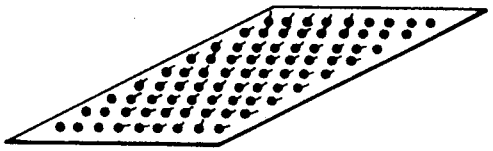
FIG. 7B
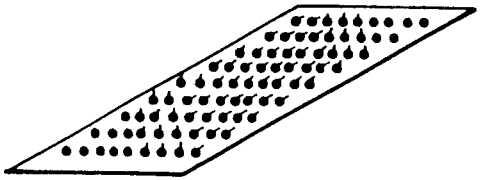
FIG. 7C
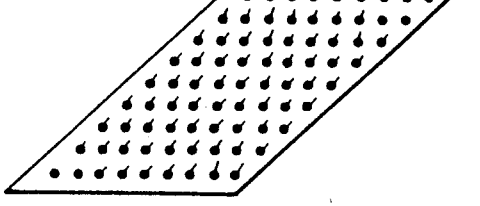
FIG. 7D
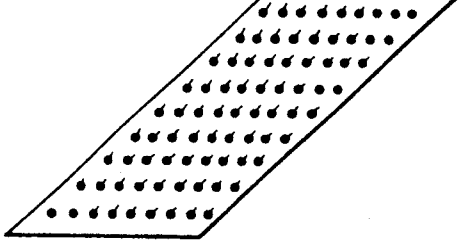
FIG. 7E
FIG. 7F

METHOD FOR MANUFACTURING A THERMAL HEAD

BACKGROUND OF THE INVENTION

1. Field of the Invention

The present invention relates to a method for manufacturing a thermal head for half-tone printing.

2. Description of the Related Art

Thermal heads with a novel faculty have been intensively developed of late such that half-tone printing can be effected by changing the size of printing dots to be printed. Such thermal heads are disclosed in "Half Tone Wax Transfer Using a Novel Thermal Head", THE FOURTH INTERNATIONAL CONGRESS ON ADVANCES IN NON-IMPACT PRINTING TECHNOLOGIES pp. 273–276, "Thermo-Convergent Ink-Transfer Printing (TCIP) for Full Color Reproduction", Proceedings of 2nd Non-impact Printing Technologies Symposium pp. 105–108, "Published Unexamined Japanese Patent Application Nos. 60-58877 and 60-78768". Each of the thermal heads is provided with a number of heating resistors each having a narrow-width portion. Electric current flowing through each heating resistor increases its density at the narrow-width portion, so that heat is produced from a local region in the high-density portion. In thermal heads, only those regions which produce heat higher than a certain value are effective for printing, and the regions capable of generating sufficient heat for the printing spread in proportion to voltage applied to the heating resistors. If higher voltage is applied to the heating resistors, therefore, the size of the printing dots increases in proportion.

In the conventional thermal head of this type, however, the heating resistors have a complicated configuration, so that manufacturing them requires much time and labor, and it is difficult to provide uniform properties for the numerous heating resistors.

SUMMARY OF THE INVENTION

To provide a solution to the above-mentioned problems, the present inventors proposed a thermal head designed for half-tone printing and including a plurality of parallelogrammatic resistors. A patent is being sought for this thermal head in a U.S. patent application Ser. No. 558,480 filed July 27, 1990 and an EPC Patent Application No. 90114494.9 filed July 27, 1990.

An object of the present invention is to provide a method for easily manufacturing such a thermal head at low cost.

According to the invention, the thermal head which has a plurality of parallelogromatic resistors along its main scanning axis is fabricated as follows. A plurality of lead electrodes are formed on an insulating substrate such that the lead electrodes are arranged at regular intervals in parallel to on another and extend diagonally with respect to the main scanning axis. Then, at least one strip-shaped resistor is formed on the resultant structure to extend along the main scanning axis and across the lead electrodes, whereby the thermal head is obtained. In this thermal head, each area defined by any two adjacent lead electrodes and a pair of opposite side edges of the strip-shaped resistor forms a parallelogrammatic resistor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 7A–7L are views showing how current is distributed in each of various-shape parallelogrammatic resistors, the views in FIGS. 7A–7L being obtained by the boundary element method;

DETAILED DESCRIPTION OF THE PREFERRED EMBODIMENT

An embodiment of the present invention will now be described, with reference to the accompanying drawings.

Figure 1:
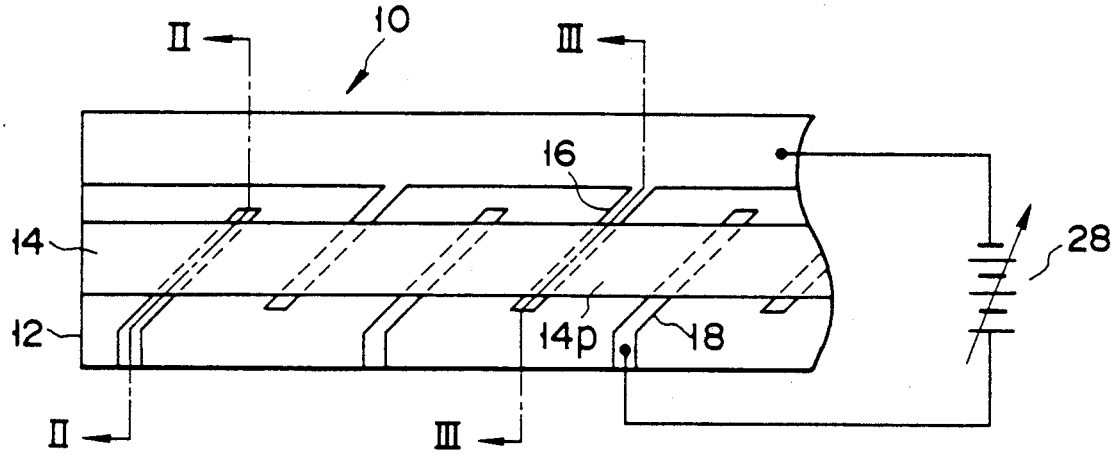
FIG. 1 is a view of a thermal head manufactured by use of a method embodying the present invention.

Referring first to FIG. 1, a thermal head 10 comprises a plurality of a of parallelogrammatic resistors 14*p* formed on an insulating substrate 12 and arranged in the direction of the main scanning axis, i.e., in the longitudinal direction of the substrate 12. Each parallelogrammatic resistor 14*p* has its one pair of opposite sides connected to lead electrodes 16 and 18, respectively, and constitutes one heating resistor used for recording one pixel. The lead electrodes 16 are connected together, thus constituting a common electrode.

Figure 2:
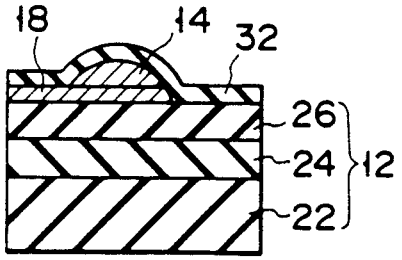
FIG. 2 is a sectional view taken along line II—II in FIG. 1.
Figure 3:
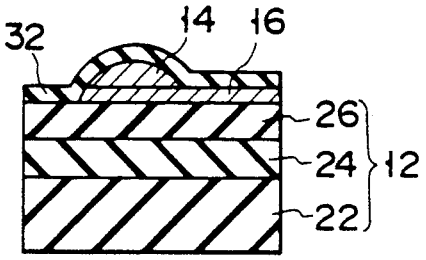
FIG. 3 is a sectional view taken along line III—III in FIG. 1.

The thermal head 10 is fabricated as follows. First, a substantially rectangular insulating substrate 12 is prepared. As is shown in FIGS. 2 and 3, the insulating substrate 12 has a laminated structure made up of: a support layer 22, a base layer 24, and a glaze layer 26, for example. Next, pairs of parallel lead electrodes 16 and 18 are formed on the insulating substrate 12 such that they extend slantwise with reference to the direction of the main scanning axis and such that they are spaced from each other at regular intervals. The lead electrodes 16 and 18 are formed by use of a lithography technology, including deposition and etching. Subsequently, a strip-shaped resistor 14 extending in the direction of the main scanning axis is formed on the insulating substrate 12 by coating the insulating substrate 12 with paste of a heating resistor material by screen printing. Finally, a protective layer 32 is formed on the resultant structure, so as to prevent the resistor 14 and the lead electrodes 16 and 18 from being oxidized or worn away. In the thermal head 10 fabricated as above, each of those portions of the strip-shaped resistor which are defined by a pair of lead electrodes 16 and 18 serves as a parallelogrammatic heating resistor 14*p* used for recording one pixel.

Figure 4:
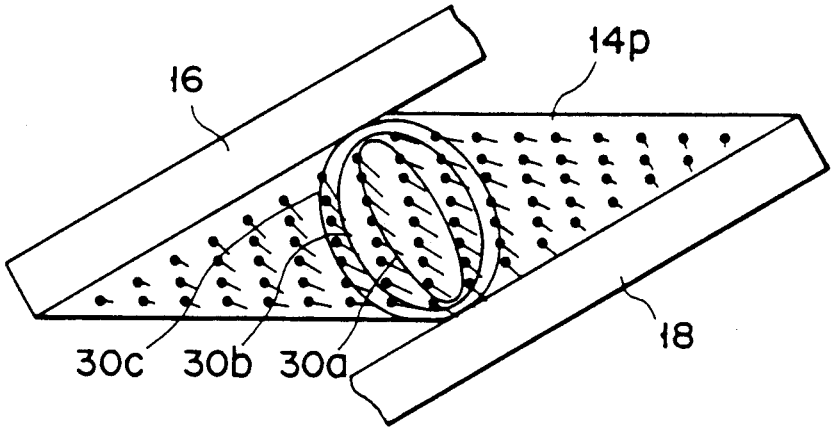
FIG. 4 is a view illustrating how current is distributed and how heat is generated in a heating resistor shown in FIG. 1.

When a voltage from a variable voltage source 28 is applied between the lead electrodes 16 and 18, for example, a current flows through the heating resistors 14*p*, so that the resistors 14*p* are heated. FIG. 4 shows current distribution in the resistors 14*p*. In FIG. 4, black spots represent points of measurement, the direction of each line indicates the direction of electric current at each corresponding measurement point, and the length of the line indicates the magnitude of the current at the measurement point.

The following is a description of the current distribution in the heating resistors 14*p* shown in FIG. 4. Here it is supposed that the resistance values of the resistors 14*p* cannot be changed by heating. For example, each resistor 14*p* is formed of a thin film whose thickness is so small that it is negligible. Thus, the current distribution is supposed to be two-dimensional.

Based on this supposition, the current flowing through the heating resistors 14*p* is a steady-state current, which generates a static magnetic field. Since magnetic flux density B makes no time-based change, therefore, the following equation is obtained from the Maxwell equation:

$$\text{rot } E = -\frac{\partial B}{\partial t} \quad (1)$$

where E is an electric field. Based on the principle of conservation of charge, moreover, we obtain $$\text{div } i = 0, \ldots \quad (2)$$

where i is the current density. The Ohm's law is valid for the relation between the current density i and the electric field E as follows:

$$i = \sigma E, \ldots \quad (3)$$

where $\sigma$ is electric conductivity. Substituting equation (3) into equation (2), we obtain $$\text{div } E = 0. \ldots \quad (4)$$

From equations (1) and (4), we recognizes a certain scalar function V, and the electric field E may be given by $$E = -\text{grad } V. \ldots \quad (5)$$

This scalar function V is generally called as an electric potential. Substituting equation (5) into equation (4), in consideration of the two-dimensional current distribution, we obtain the following Laplace equation:

$$\frac{\partial^2 V}{\partial x^2} + \frac{\partial^2 V}{\partial y^2} = 0 \quad (6)$$

Further, energy density en is given by $$e_n = i \cdot E = \sigma E^2. \ldots \quad (7)$$

By obtaining the electric field E by substituting the solution of equation (6) into equation (5), therefore, heating energy distribution can be obtained from equation (7).

Figure 5:
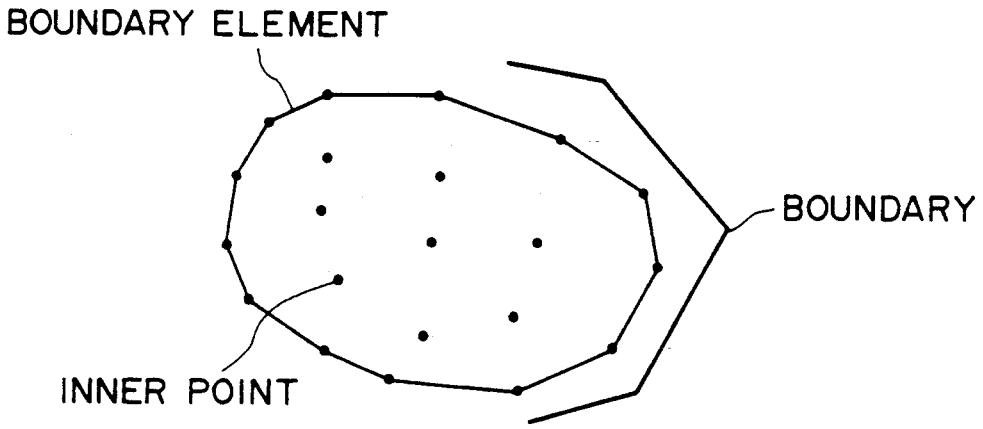
FIG. 5 is an explanatory view of a boundary element method.

Using the boundary element method, equation (6) will now be numerically analyzed. According to the boundary element method, as shown in FIG. 5, the boundary of a closed system is divided into elements, which are calculated using predetermined boundary conditions so that the solutions of all the elements are obtained. Thus, the internal conditions of the system are detected. As a result, the current distribution shown in FIG. 4 is obtained.

As seen from FIG. 4, there are larger current flows in the regions nearer to the center of each heating resistor 14*p*. The heat release value at a certain point on the resistor 14*p* can be represented by the product of the square of the current value at that position and the resistance value of the resistor 14*p*. Namely, the heat release value is proportional to the square of the current value. Thus, the heat value is large at the central portion of the heating resistor 14*p*.

Meanwhile, recording of printing dots requires a fixed amount of heat or more. If the voltage applied to the heating resistor 14*p* is low, therefore, the printing dots are recorded by heating within a range indicated by numeral 30*a* in FIG. 4. As the applied voltage is increased, the printing dots start to be recorded by heating within ranges indicated by numerals 30*b* and 30*c*.

By changing the voltage applied to the heating resistor 14*p*, the virtual heating area can be varied as indicated by 30*a*, 30*b* and 30*c* in FIG. 4, for example, so that the size of the printing dots can be modulated.

Figure 6:
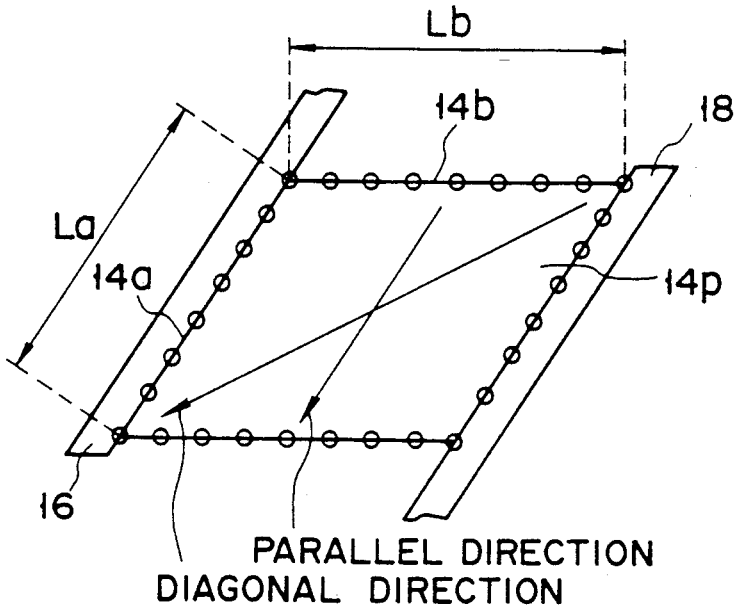
FIG. 6 shows the factors for defining the shape of a parallelogrammatic resistor.

The current distribution in the heating resistor 14*p* varies depending on the shape of the resistor, and there is a resistor shape for optimum gradation recording. This is a shape which enables heat concentration to a certain degree or higher. Parameters indicative of a parallelogrammatic shape include the ratio g between the respective lengths La and Lb of sides 14*a* and 14*b* and the angle $\theta$ (acute angle in this case) formed between the sides 14*a* and 14*b*, as shown in FIG. 6. The optimum shape can be obtained under the following conditions:

$$\text{ratio } g\ (= Lb/La) = 1,$$

$$\text{angle } \theta \leqq 45°.$$

The following is a description of the optimum shape of the heating resistor 14*p*. In the example described below, the thermal head is applied to a standard-G3 facsimile.

In the standard-G3 facsimile, the resolution in the direction of the main scanning axis is specified as being 8 dots/mm, so that the width or length La of each heating resistor 14*p* is $$La \leqq 125\ \mu m.$$

If the gap between each two adjacent heating resistors 14*p* is 25 $\mu$m, La is $$La = 100\ \mu m.$$

FIGS. 7A to 7L show various modes of current distribution obtained for 12 varied shapes by the aforementioned method using the outline of each heating resistor 14p as a boundary, as shown in FIG. 6, under conditions including La=100 μm and the respective electric potentials of the lead electrodes 16 and 18 at 24V and 0V. The 12 shapes may be classified into four types based on the combinations of the ratios g of 1. 1.5, and 2 and the angles $\theta$ of 30° (type (a)), 45° (type (b)), 60° (type (c)), and 75° (type (d)).

Figure 7G:
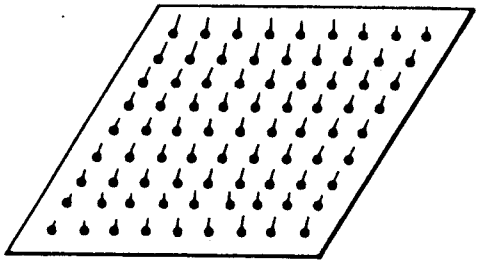
Figure 7H:
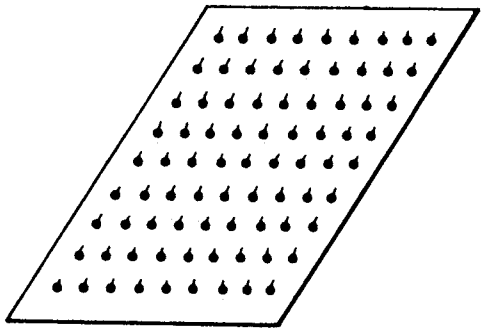
Figure 7I:
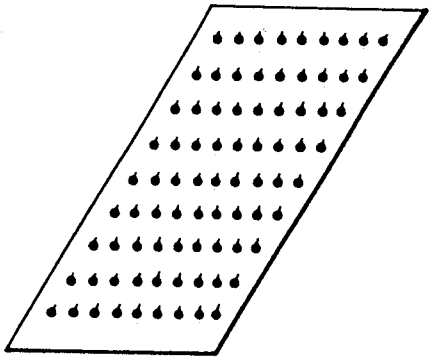
Figure 7J:
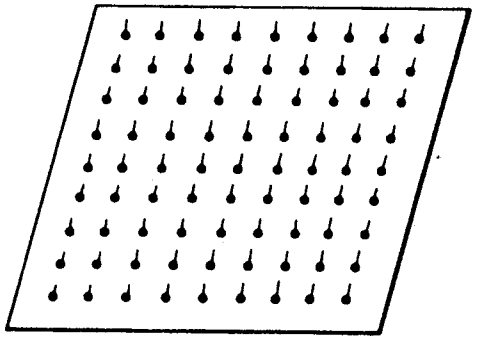
Figure 7K:
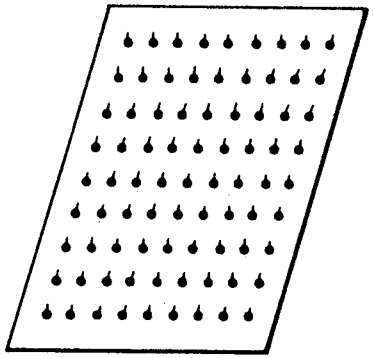
Figure 7L:
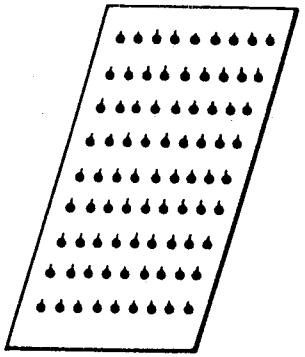

FIGS. 7A to 7C show cases corresponding to the ratios g of 1, 1.5, and 2, respectively, for type (a), and FIGS. 7D to 7F, 7G to 7I, and 7I to 7L show similar cases for types (b), (c), and (d), respectively.

The electric fields E in the horizontal and diagonal directions (see FIG. 6) are obtained for the individual heating resistors 14p having these shapes. FIGS. 8 to 13 show $e_n/\sigma$ obtained by dividing the energy density $e_n$, calculated according to equation (7) on the basis of the obtained electric fields E, by the electric conductivity $\sigma$.

Figure 8:
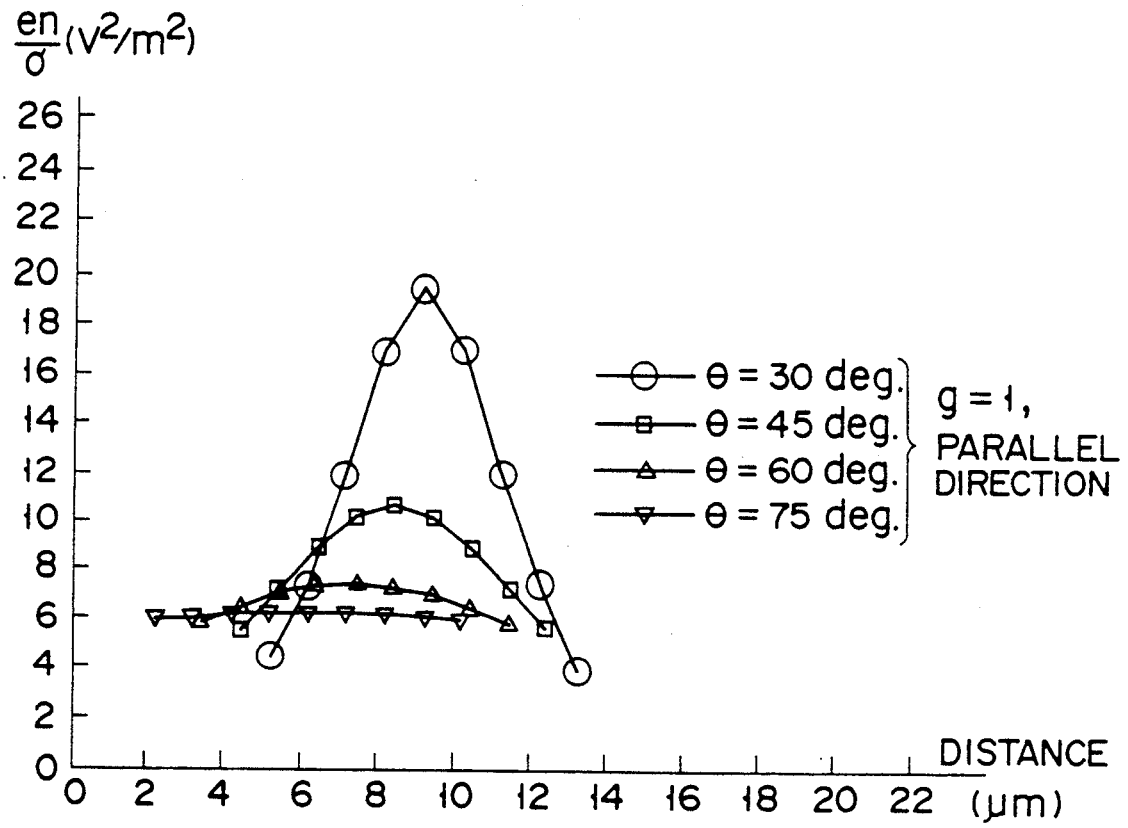
FIGS. 8–13 are graphs showing energy distributions obtained by calculation.
Figure 9:
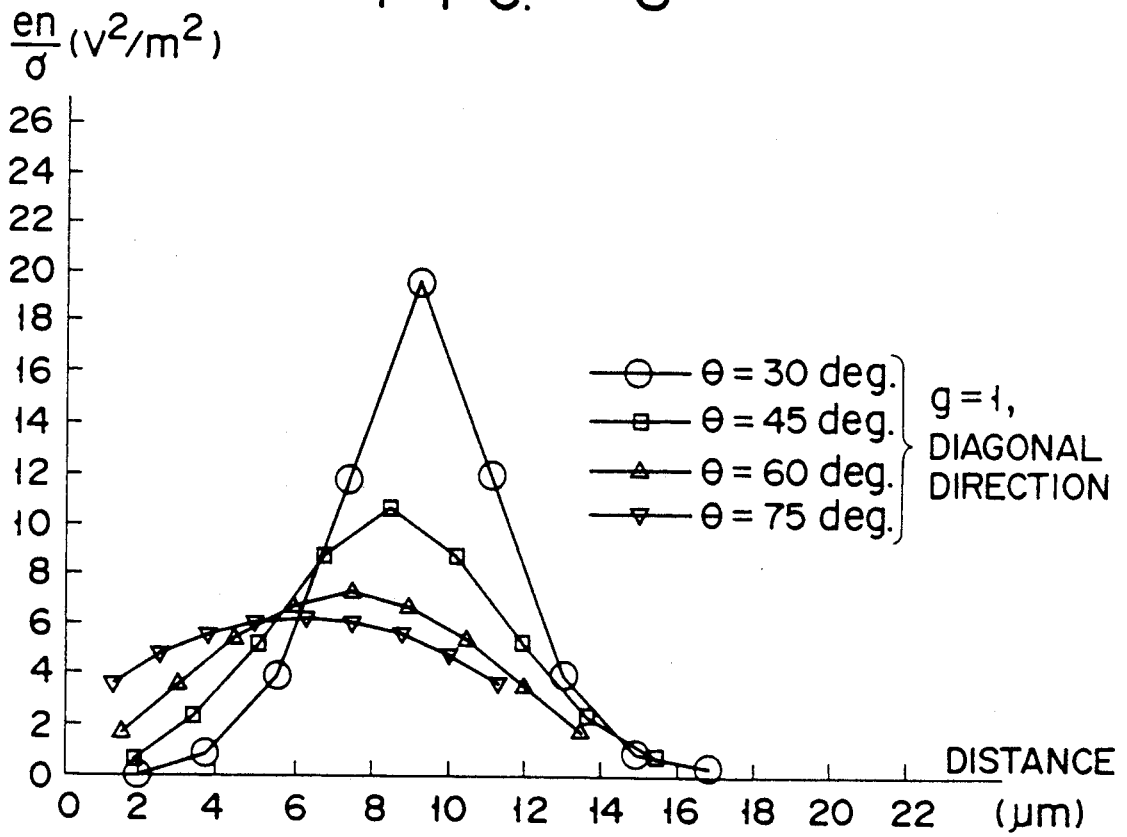
Figure 10:
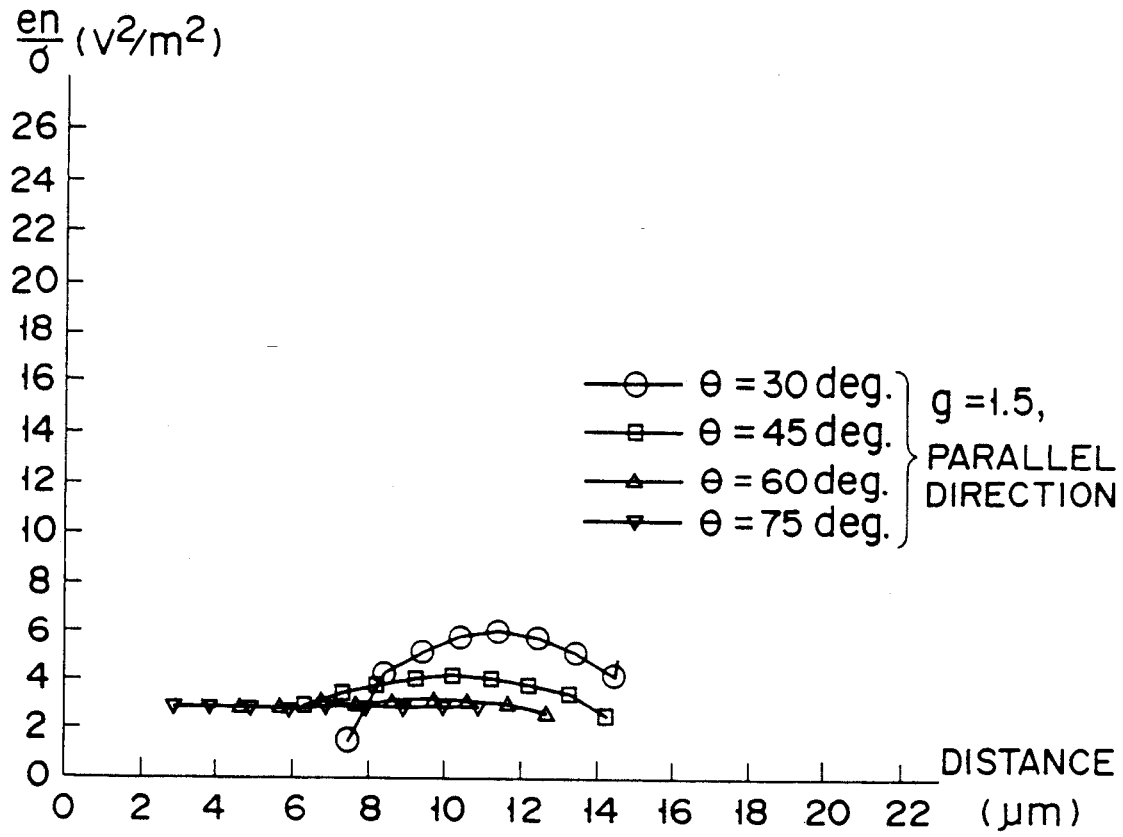
Figure 11:
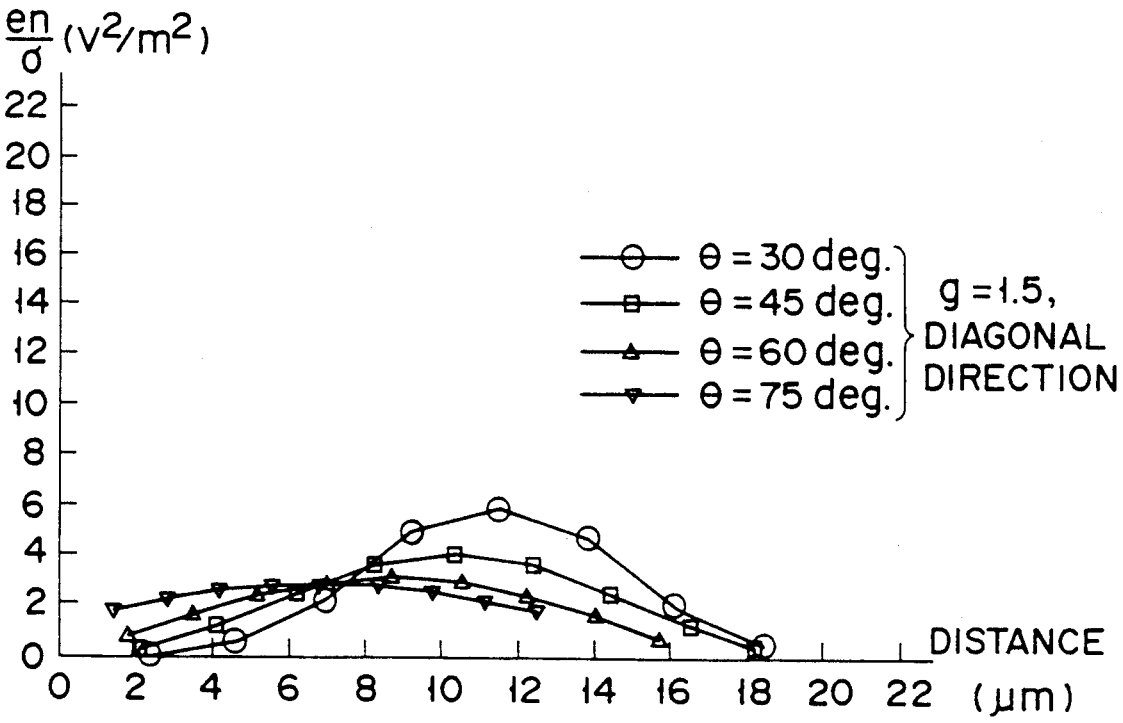
Figure 12:
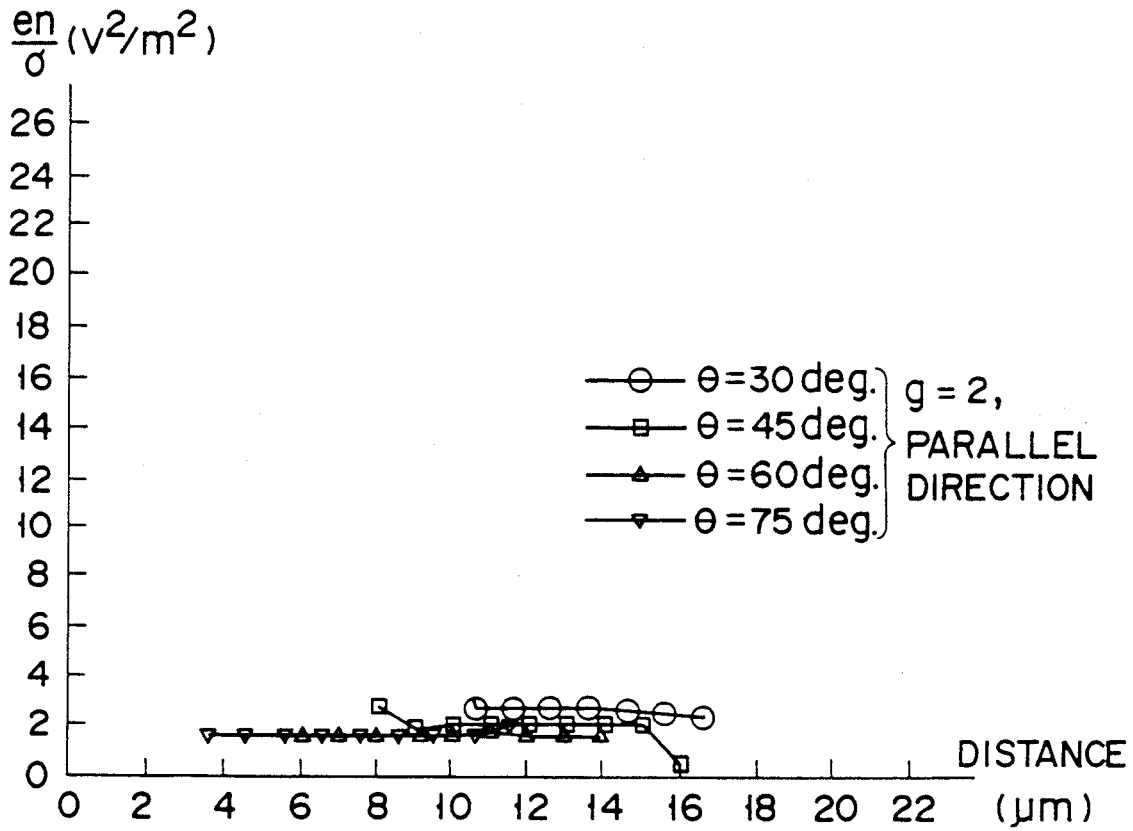
Figure 13:
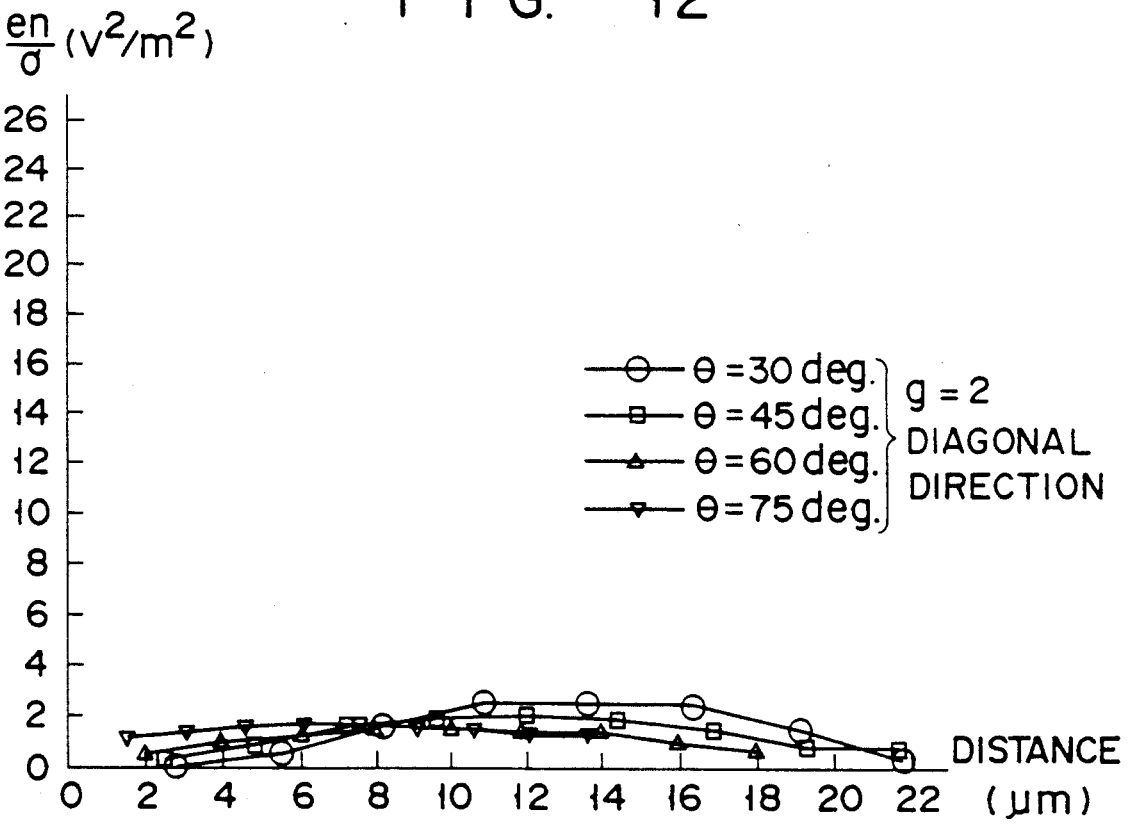

FIGS. 8 and 9 show cases corresponding to the horizontal and diagonal directions, respectively, for the ratio g of 1, FIGS. 10 and 11 show similar cases for the ratio g of 1.5, and FIGS. 12 and 13 show similar cases for the ratio g of 2.

As seen from FIGS. 7A to 7L and FIGS. 8 to 13, the smaller the angle $\theta$ and ratio g, the more intensive the centralization of the current is. FIGS. 8 to 13 indicate the following circumstances. If the ratio g is 2 (FIGS. 12 and 13), the energy distribution is substantially uniform, and there is hardly any energy concentration. If the ratio g is 1.5. some energy concentration is caused. If the ratio g is 1, a considerable energy concentration is entailed. As seen from FIGS. 8 and 9, moreover, if the ratio g is 1, the energy concentration is conspicuous when the angle $\theta$ is 45° or less.

In light of the above, it is possible to assume that the conditions for providing each heating resistor 14p are: $g \leqq 1$, and $\theta \leqq 45°$. Since the width La of the heating resistor is 100 μm, the height h thereof (height: the length defined in the sub-scanning direction) is defined by $h < 100/\sqrt{2}$ μm. That is, the height of the resistor is no more than 71 μm or so. A heating resistor having such dimensions is suitable in the case where the resolution in the sub-scanning direction is higher than 15.4 lines/mm.

The resolutions normally available in a G3-type facsimile machine are: 8 dots/mm×7.7 lines/mm, 8 dots/mm×3.85 lines/mm, etc. In these cases, the resolutions in the sub-scanning direction are lower than 15.4 lines/mm. The thermal head of the above-mentioned embodiment is not applicable to such low-resolution recording, though it is suitable for recording with the resolution of 15.4 lines/mm.

Figure 14:
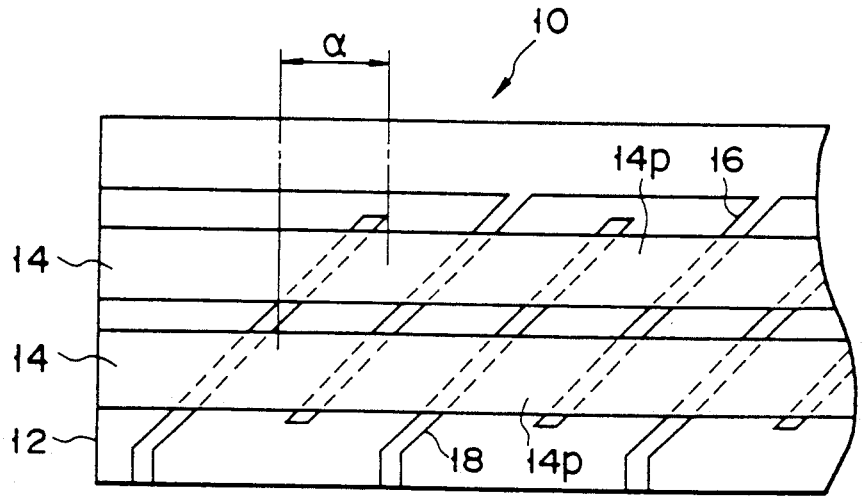
FIG. 14 shows the structure of a thermal head suitable for low-resolution recording.

Another type of thermal head which is suitable for low-resolution recording will be described, with reference to FIG. 14. In FIG. 14, the members which are similar to those used in the above-mentioned thermal head will be referred to by the same reference numerals and symbols, and a detailed description of them will be omitted herein.

The second type of thermal head 10 comprises an insulating substrate 12, and two strip-shaped resistors 14 which are formed on the insulating substrate 12 and extend in parallel to each other in the direction of the main scanning axis. The two strip-shaped resistors 14 are spaced from each other by a predetermined short distance. As mentioned above, the strip-shaped resistors 14 are formed on the substrate by coating the insulating substrate 12 with paste of a heat-generating resistor material by screen printing. The thermal head 10 also comprises a pair of lead electrodes 16 and 18 which extend in parallel to each other and cross the two strip-shaped resistors 14 slantwise. As in the above-mentioned thermal head, each of those portions of the strip-shaped resistor 14 which are defined by a pair of lead electrodes 16 and 18 serves as a parallelogrammatic heating resistor 14p used for recording one printing dot. Each heating resistor 14p satisfies the above-mentioned optimal conditions: namely, $g \leqq 1$, and $\theta \leqq 45°$. In the second type of thermal head, the adjacent heating resistors 14p that are connected in common to the same two lead electrodes 16 and 18 function as one heat-generating section used for recording one pixel. If it is assumed that each heating resistor 14p has a width of 100 μm, a height of 70 μm and an angle of 45°, then the height of the heat-generating section is about 140 μm, which is a value corresponding to 7.7 lines/mm.

In the second type of thermal head, each heating resistor 14p satisfies the optimal conditions mentioned above, so that its heat-generating characteristic is suitable for half-tone printing. Therefore, satisfactory half-tone printing can be performed with a resolution of 8 dots/mm×7.7 lines/mm.

If the number of strip-shaped resistors 14 is four, recording can be performed with a resolution of 8 dots/mm×3.85 lines/mm. In this way, an arbitrary resolution may be obtained by changing the number of strip-shaped resistors 14.

In the thermal head shown in FIG. 14, the centers of the two parallelogrammatic resistors 14p which jointly records one pixel are shifted by $\alpha$ in the direction of the main scanning axis. Therefore, the two printing dots corresponding to one pixel are shifted by $\alpha$ in the main scanning direction. In some cases, this may result in a certain degree of deterioration in the quality of an image.

A thermal head that gives solution to this problem will be described, with reference to FIG. 15.

Figure 15:
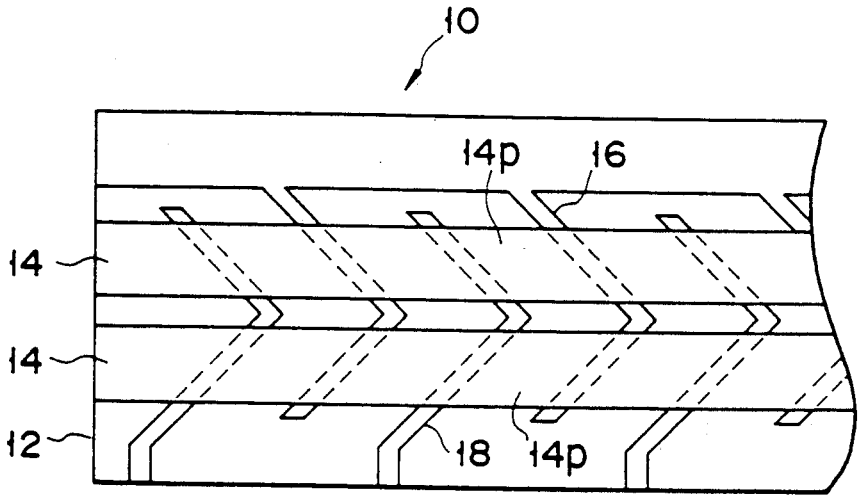
FIG. 15 shows the structure of an improved thermal head suitable for low-resolution recording.

Referring to FIG. 15, the thermal head 10 comprises a pair of parallel strip-shaped resistors 14 extending in the direction of the main scanning axis, and two parallel lead electrodes 16 and 18 diagonally crossing the strip shaped resistors 14. As is shown in FIG. 15, each of the lead electrodes 16 and 18 is bent at an intermediate point thereof such that it is substantially "L"-shaped. A parallelogrammatic heating resistor 14p is defined by the adjacent ones of the substantially "L"-shaped lead electrodes 16 and 18. In the case where slanting sides of the heating resistor 14p are slanted 45°, the angle at which the lead electrodes 16 and 18 are bent is 90°. The two heating resistors 14p which are defined by such lead electrodes and which are jointly used for printing one pixel are at the same location in the direction of the main scanning axis. Therefore, satisfactory half-tone printing is ensured with a resolution of 8 dots/mm×7.7 lines/mm, without resulting in deterioration in the quality of an image.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method for manufacturing a line-type thermal head which has a main scanning axis, comprising the steps of:

forming a plurality of lead electrodes on an insulating substrate such that the lead electrodes are arranged at regular intervals in parallel to one another and extend diagonally with reference to the main scanning axis; and forming at least one strip-shaped resistor, which has parallel opposite side edges, on the insulating substrate and the lead electrodes, such that the strip-shaped resistor extends along the main scanning axis and crosses the lead electrodes, wherein a parallelogrammatic heating resistor used for recording one pixel is defined by adjacent ones of the lead electrodes and the opposite side edges of the strip-shaped resistor.

2. A method according to claim 1, wherein said strip-shaped resistor is formed by coating the insulating substrate with paste of a resistor material by screen printing.

3. A method according to claim 1, wherein two or more strip-shaped resistors insulated from each other are formed by said step of forming at least one strip-shaped resistor.

4. A method according to claim 3, wherein each of said lead electrodes includes a bent portion located between adjacent ones of the strip-shaped resistors, and a plurality of parallelogrammatic resistors which are defined by adjacent two lead electrodes and the opposite side edges of the strip-shaped resistors are at the same location in the direction of the main scanning axis.

* * * * *